313-414 SR
6/14/77 OR 4,029,988

United States Patent [19] [11] 4,029,988
Say [45] June 14, 1977

[54] CRT IN-LINE ELECTRON GUN ASSEMBLY

[75] Inventor: Donald L. Say, Waterloo, N.Y.

[73] Assignee: GTE Sylvania Incorporated, Stamford, Conn.

[22] Filed: June 24, 1976

[21] Appl. No.: 699,424

[52] U.S. Cl. ..... 313/414; 313/409
[51] Int. Cl.[2] ..... H01J 29/50; H01J 29/51
[58] Field of Search ..... 313/414, 412, 409, 411, 313/413, 415

[56] References Cited

UNITED STATES PATENTS

| | | | |
|---|---|---|---|
| 3,619,686 | 11/1971 | Miyaoka | 313/412 |
| 3,755,703 | 8/1973 | Ueno et al. | 313/409 |
| 3,873,879 | 3/1975 | Hughes | 313/413 X |
| 3,883,771 | 5/1975 | Ohgoshi et al. | 313/412 |

*Primary Examiner*—Robert Segal
*Attorney, Agent, or Firm*—Norman J. O'Malley; Frederick H. Rinn; Robert T. Orner

[57] ABSTRACT

An improvement is provided in a cathode ray tube plural-beam in-line electron gun assembly having applied beam currents of differing levels. At least one of the gun constructions in the assembly incorporates discrete electrode structural modifications whereby the respective focusing lens is dimensionally changed to effect a focused beam landing at the screen that is of a size similar to those of the beams emanating from the related guns in the assembly.

5 Claims, 7 Drawing Figures

Fig. 1
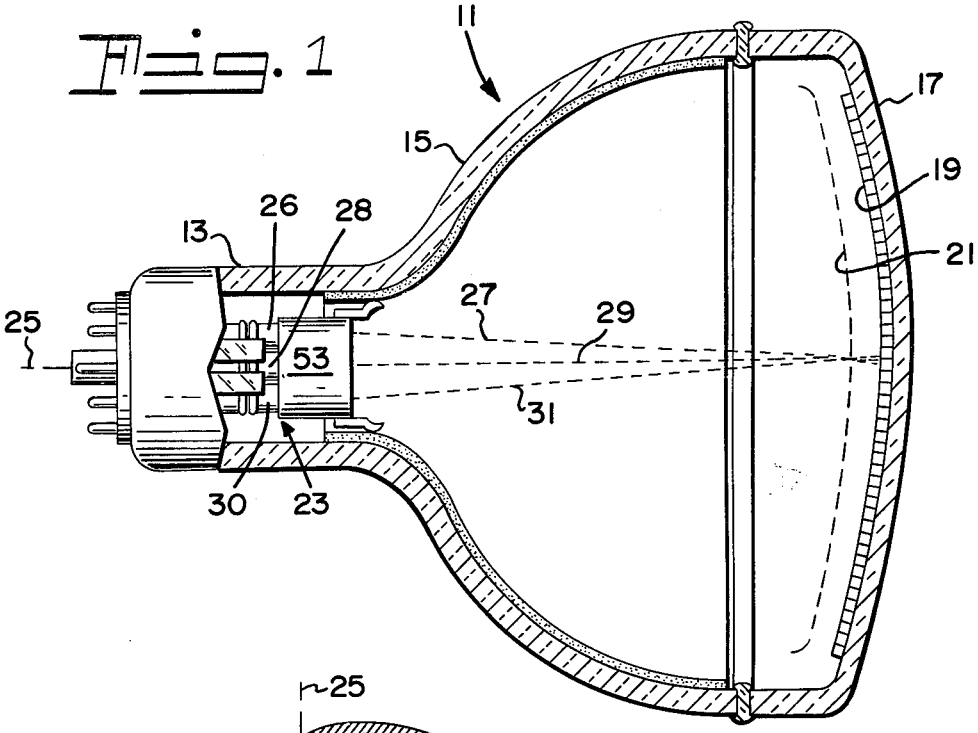
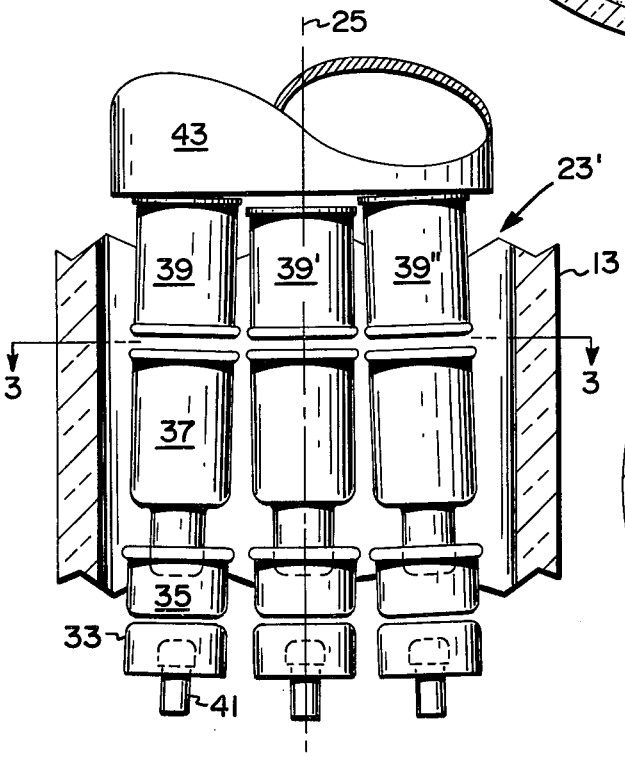
Fig. 2
PRIOR ART
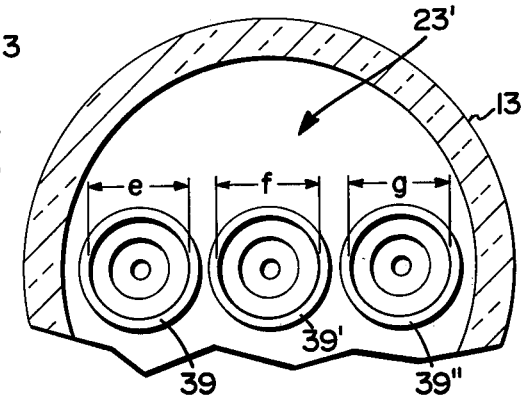
Fig. 3
PRIOR ART

CRT IN-LINE ELECTRON GUN ASSEMBLY

CROSS REFERENCE TO RELATED APPLICATIONS

This application contains matter disclosed but not claimed in two related United States patent applications filed concurrently herewith and assigned to the assignee of the present invention. These related applications are Ser. No. 699,440, and Ser. No. 699,441.

BACKGROUND OF THE INVENTION

This invention relates to a plural beam cathode ray tube and more particularly to modifications of a multi-beam in-line electron gun structure employed in a color cathode ray tube.

Many of the cathode ray tubes presently utilized in color television display applications are of the type employing a patterned multi-phosphor cathodoluminescent screen interiorly disposed on the viewing panel of the tube envelope wherein an apertured or multi-opening mask is spatially positioned in relation thereto. A plurality of electron beams, emanating from an electron gun assembly positioned within the neck portion of the envelope are directed to converge at and traverse the apertured mask to impinge and luminescently excite the electron responsive phosphors comprising the patterned screen therebeyond. Focusing of the individual electron beams is conventionally achieved by means of discrete electron lensing, such as bipotential focus lensing; such being dependent on the ratio of the focus voltage to the respective accelerating electrode or anode voltage.

The aforementioned cathodoluminescent screen is of the type made up of repetitive patterns formed of individual dots or stripes of red, blue and green-emitting phosphor components. Since these phosphor materials exhibit differences in efficiency, they require excitation by electron beams of different current levels to produce substantially equal light output. Additional differences in excitation current arise because of the non-uniform response of the human eye to various colors. Thus, to produce white light, more beam current is required to excite the green-emitting phosphor than is necessary to excite the respective red and blue color-emitting components. Each of the beams emanates from a separate electron gun comprising the gun assembly. In a conventional assembly the several cooperating electrode components of each gun are substantially dimensionally similar to the respective components of the related guns in the assembly.

The differences of operating intensities of the several electron beam producing guns functioning simultaneous within the tube to provide a desired white, are conventionally expressed in terms of at least two gun current ratios; namely, red to green (R/G) and red to blue (R/B). For example, in a tube having the red, green, and blue electron guns operating simultaneously to provide a desired cathodoluminescent white, a red/green gun ratio of 1.5:1 indicates that an electron beam current of 50 percent greater intensity is required from the red gun than is needed from the green gun to provide the necessary individual brightness levels of the respective red and green-emitting phosphors. Correspondingly, in the same tube, a red/blue gun ratio of 1.6:1 denotes that the red gun must deliver 60 percent more beam current than the blue gun to satisfactorily complete the white field in the simultaneously excited screen. In accordance with the electron-optics properties of electron guns, the diameter of the electron beam becomes larger as the beam current is increased. Thus, the apparent sharpness of the imagery evidenced in the screen of a color cathode ray tube is resolved in accordance with the respective beam diameters impinging the associated phosphor components of the patterned screen. Accordingly, reduced brightness and diminished resolution of imagery is evidenced with beam landings of larger spot size.

OBJECTS AND SUMMARY OF THE INVENTION

It is an object of the invention to reduce and obviate the aforementioned disadvantages evidenced in the prior art. Another object of the invention is to effect structural changes within the electron gun assembly to provide improved resolution of color cathode ray tube imagery with an associated increase of brightness. A further object of the invention is to effect structural gun changes in the assembly to improve resolution of cathode ray tube imagery without requiring an increase in the neck diameter of the envelope.

These and other objects and advantages are achieved in one aspect of the invention wherein there is provided an improvement in the structure of the cathode ray tube plural beam in-line electron gun assembly wherein at least one gun structure of the assembly, having a beam current level differing from that of the other guns therein, is modified to effect a change in the length of the focusing lensing affecting the electron beam traversing therethrough. This structural modification is effected by changing the length of the focusing electrode member in conjunction with the change of diameter of the output portion of the focusing electrode along with a compatible diametrical change of the related acceleration electrode, to provide a modification of the final focusing lensing formed inter-spatially between the focusing and final acceleration electrode members. This modified final lensing provides focusing of the respective beam to a spot size at the screen which is of a dimension substantially equalling the spot sizes of the associated beams having differing beam currents and emanating from the related guns of the assembly. Thus, by these structural modifications there is provided a marked improvement in the total effective resolution and brightness of the display imagery evidenced in the screen of the tube.

BRIEF DESCRIPTION OF THE DRAWINGS

FIG. 1 is an illustration of a color cathode ray tube partially sectioned to show the environment wherein the improvement of the invention is oriented;

FIG. 2 is a prior art elevational view of an in-line three-beam cathode ray tube electron gun assembly;

FIG. 3 is a prior art plan view of the gun assembly illustrated in FIG. 2, taken along the line 3—3 thereof, showing the equal diameters of the related gun structures;

DESCRIPTION OF THE PREFERRED EMBODIMENTS

Figure 4:
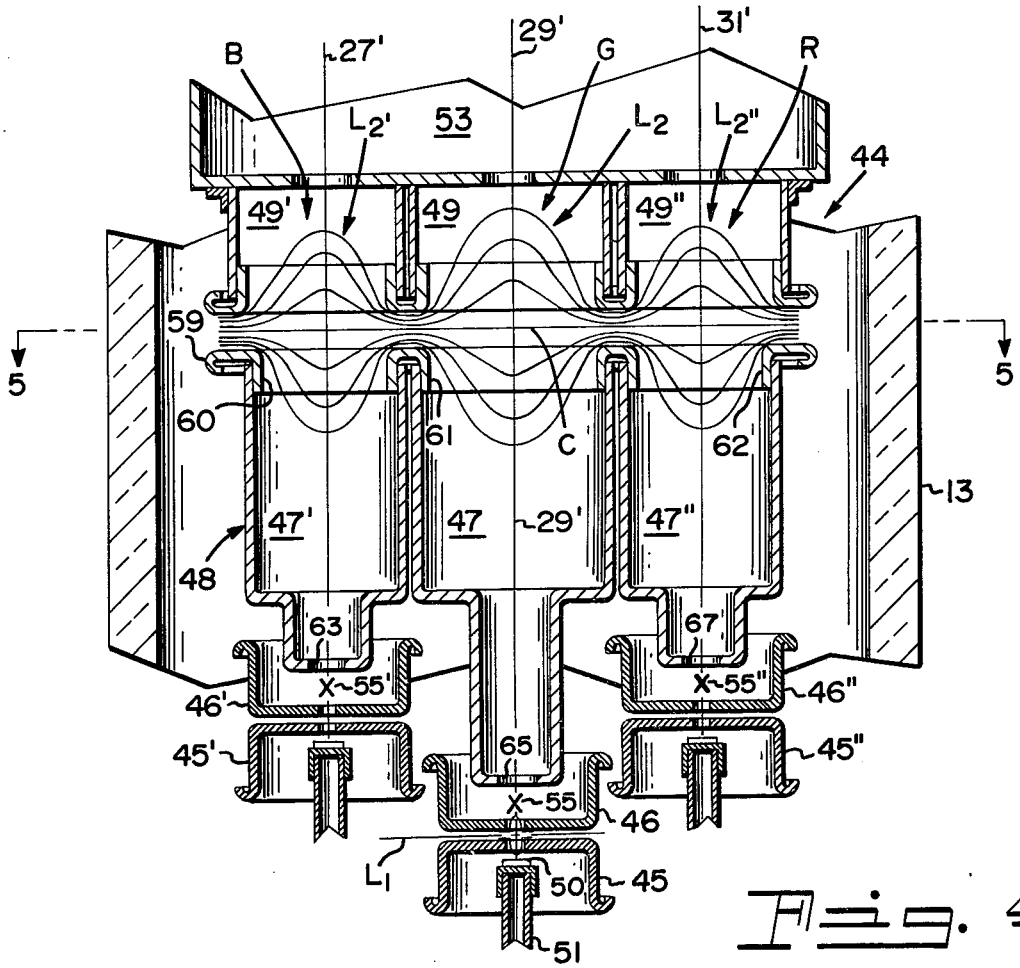
FIG. 4 is a sectional view illustrating the improved gun structure of the invention.

For a better understanding of the present invention, together with other and further objects, advantages and capabilities thereof, reference is made to the following specification and appended claims in connection with the aforedescribed drawings.

With reference to the drawings, there is shown in FIG. 1 a partially sectioned multibeam color cathode ray tube 11 having an encompassing envelope comprised of an integration of a neck portion 13, a funnel portion 15 and a face or viewing panel portion 17. A patterned screen 19 including a repetitive plurality of color-emitting phosphor components is disposed on the interior surface of the viewing panel 17. A multi-opening mask member 21 is positioned within the viewing panel, by means not shown, in a manner whereof the multi-opening portion is spatially related to the patterned screen 19. Positionally encompassed within the neck portion 13 of the envelope is a multi-beam in-line electron gun structure 23, such as, for example an assembly structure of three bi-potential guns 26, 28 and 30, having a longitudinal axis 25 therethrough. The guns of this assembly form and direct three separate electron beams 27, 29, 31 to discretely impinge the patterned screen 19. It is within this electron gun assembly 23 that the improvement of the invention resides.

To fully understand the marked significance of the invention, attention is directed to FIGS. 2 and 3 wherein a prior art plural beam in-line gun structure 23' is shown. In a multi-beam structure of this type, each of the respective beams 27, 29 and 31 traverses a substantially longitudinal arrangement of several functionally related electrode members including, as for example, a control electrode 33, and an initial accelerator 35, a focusing electrode 37, and a final accelerator 39 all of which are positioned in a sequential manner forward of a rear-oriented cathode member 41. Terminally positioned on the forward portions of the final accelerators 39, 39' and 39'' is a common apertured cup-like member 43 wherein shunts and/or enhancers may be located in accordance with the known state of the art. As shown, this arrangement constitutes a bi-potential electron gun assembly for effecting the formation and control of each of the respective electron beams 27, 29 and 31. These several electrode members comprising each of the individual guns within the assembly 23 are conventionally positioned and held in spaced relationship with respect to one another by a plurality of insulative support rods, which for purposes of clarity are not shown. It is clearly evident that the diameters "*e*", "*f*" and "*g*" of the final focusing and final acceleration electrode members 37 and 39 are substantially equal. Therefore, final focusing lensing, which is formed inter-spatially between the focusing and final acceleration electrodes, is substantially equal for each of the three guns. Since each of the guns forms and directs an individual electron beam in accordance with the respective beam current applied thereto, the focus spot size of beam impingement at the screen will vary in accordance with the beam current applied to the particular gun. Thus, as a result of differing beam currents and resultant differing spot sizes the resolution and brightness of the screen imagery is noticeably impaired.

Figure 5:
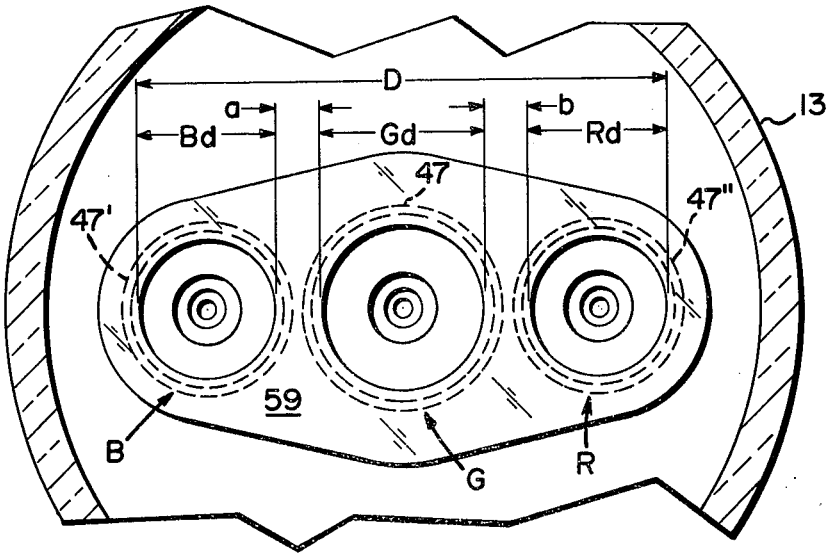
FIG. 5 is a plan view of a portion of the improved gun assembly as portrayed in FIG. 4 taken along the line 5—5 thereof, wherein varied gun diameters are shown.

The invention is an improvement relating to a modified plural beam in-line electron gun assembly as exemplarily illustrated in FIGS. 4 and 5. There is shown in this instance, a gun assembly construction 44 embodying a plurality of bi-potential structures wherein the center or green gun (G) evidences diameters G*d* of the related final focusing and final acceleration electrodes 47 and 49 which are larger than the diameters B*d* and R*d* of the respective blue (B) and red (R) side-related guns. The resultant final focusing lensing ($L_2$) formed inter-spatially between the final focusing and final acceleration electrode members 47 and 49 of the center gun (G) is of an increased diameter and focal length. The lens so formed exhibits reduced spherical aberration and efficiently focuses the beam to a landing spot size at the screen which is desirably reduced in size to substantially equal the spot sizes effected by the respective lensings ($L_2'$) and ($L_2''$) of the related (B) and (R) side oriented guns. To achieve the increased object focal length for the larger diametered center gun lensing, a longer focusing electrode 47 is required.

Referring particularly to the center gun (G) as shown in FIG. 4, the electron beam 29' emanating from the emissive material 50 of the cathode 51, in passing through the initial focusing lens ($L_1$) inter-spatially located between the control and initial acceleration electrodes 45 and 46, is directionally influenced to a crossover image 55 effected slightly within the initial accelerating electrode 46. This image or beam size is directly related to the amount of beam current applied to the gun. It is this spot size that is magnified and ultimately imaged on the screen 19 by the final focusing lensing ($L_2$). In similar manner, each of the side-related guns (B) and (R) has a respective beam crossover or image point 55' and 55'' at approximately similar locations within its respective initial acceleration electrode 46' and 46''. These images are likewise magnified and focused through their respective final focusing lensings ($L_2'$) and ($L_2''$) to impinge upon the screen.

In accordance with the invention, the diametrical dimensionings of the final focusing lensings ($L_2'$) ($L_2$) and ($L_2''$) affecting the respective electron beams 27', 29' and 31' are determined by the available planar space in the gun assembly 44 and the differing beam currents supplied to the respective (B), (G) and (R) guns. While it is possible to design each gun to have a final focusing lens of a diameter in keeping with the particular beam current applied thereto, it is most expeditious, from a constructional consideration, to provide each of the side related guns with compromised lensing. For example, a tube having a gun structure, such as is shown in FIG. 4, may have a screen responsive to the following exemplary beam currents.

| | | | | |
|---|---|---|---|---|
| (R) | red gun | = | 181 ua | or 23% of total current |
| (G) | green gun | = | 346 ua | or 43% of total current |
| (B) | blue gun | = | 273 ua | or 34% of total current |
| | | | 800 ua | Total for 9300° K white |

Averaging the red (R) and blue (B) beam currents effects a compromise percentage in the order of 28.5%.

Referring to FIG. 5, the gun structure within the encompassing neck 13 of the envelope presents the usable planar dimension (D) wherein the three gun openings must be contained. These defined diametrical openings for the blue, green and red guns respectively are denoted as B*d*, G*d*, and R*d*, and such are indicated as apertures in the planar integrating member 59 of the unitized focusing electrode structure 48. The respective apertures are individually defined by peripherally in-turned projections, such as 60, 61 and 62, whereupon the forward ends of the three cylindrical focusing electrode members 47', 47 and 47'' are telescoped and attached in a manner to extend rearward therefrom. The dimensions (a) and (b) are structurally required separation distances between the three guns. Therefore, the usable planar structural dimension (D) of the integrating member, wherein the three guns are oriented, is denoted as:

$$BD + Gd + Rd + a + b = D$$

Accordingly, the actual apertured dimensioned area per se, designated as (D') is:

$$D - a - b = D'$$

Thus, the apertured diameters of each of the (B) blue and (R) red guns, as based on beam current percentages, are in the order of:
28.5% of D' = B*d* and R*d* respectively.
Similarly, the aperture of the center or green gun is in the order of:
43.0% of D' = G*d*.

As evidenced in FIG. 4, the focusing electrode structure 48 has a rear aperture arrangement whereat three spatially related apertures 63, 65 and 67 are arranged to accommodate each of the respective beams 27', 29' and 31'; these rear apertures of the respective guns being substantially equal in diameter. It is to be noted that the rear apertures 63 and 67 of the (B) and (R) side related guns are located in a substantially common plane while the aperture 65 of the (G) center gun is in a separate rearward oriented plane parallel thereto. The longer focusing electrode 47 for the (G) center gun is necessitated by the larger diameter thereof to achieve the required focal distance from the beam crossover point 55 to the center (*c*) of the final focusing lens ($L_2$). Such dimensioning is consummated by known principles of electron optics. Accordingly, the apertured initial accelerator members 46', 46 and 46'' are positioned in substantially equal spaced relationship with the respective rear apertured portions 63, 65 and 67 of the focusing electrode structure 48. Thus, the aperture portions of the side related accelerators 46' and 46'' are in a substantially common plane while the center gun accelerator 46 is in a separate rearward oriented plane parallel thereto. In keeping therewith, the apertured control electrode members 45', 45 and 45'' are positioned in substantially equal spaced relationship with respective initial accelerator members 46', 46 and 46''. Thus, the apertured portions of the side related control electrodes 45' and 45'' are in a substantially common plane while the center gun electrode 45 is in a separate rearward oriented plane and parallel thereto. In this embodiment, the respective control and associated accelerator members are individual cup-shaped members, all of which are suitably supported by conventional longitudinal insulative support rods, not shown.

Figure 6:
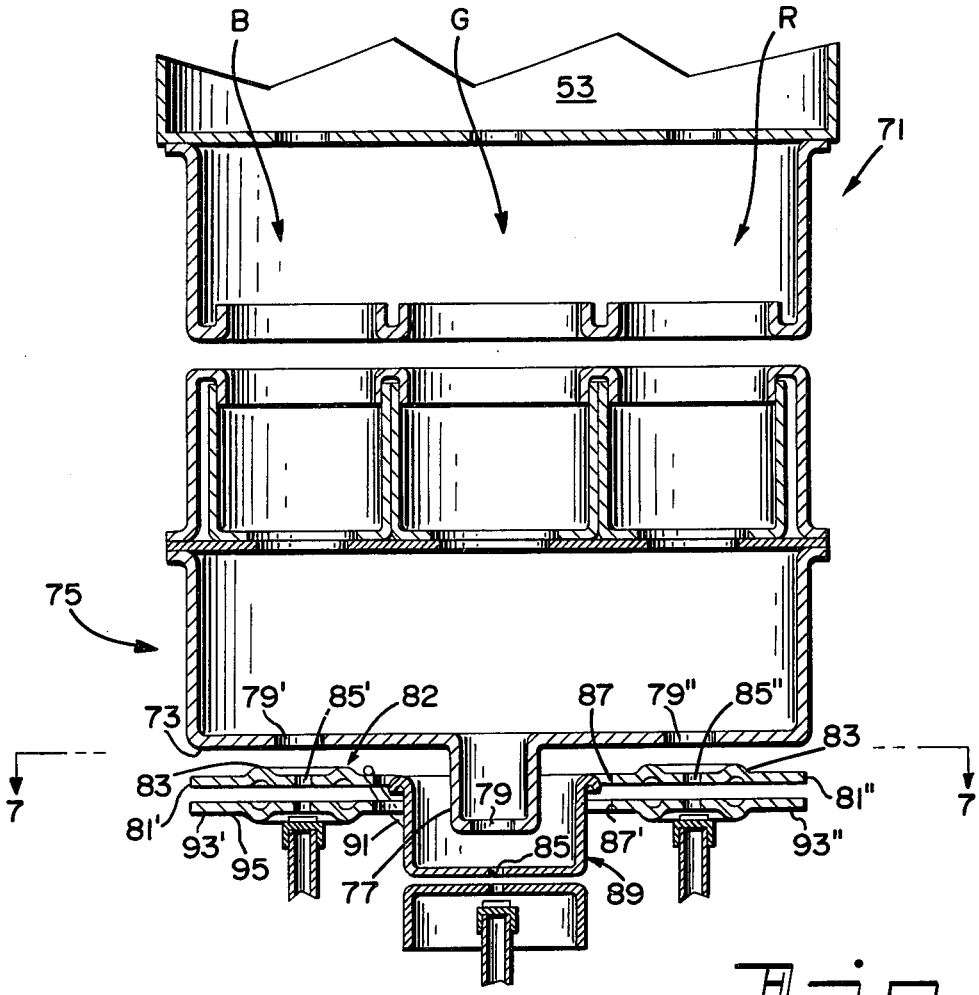
FIG. 6 is a sectional view of another embodiment of the invention.
Figure 7:
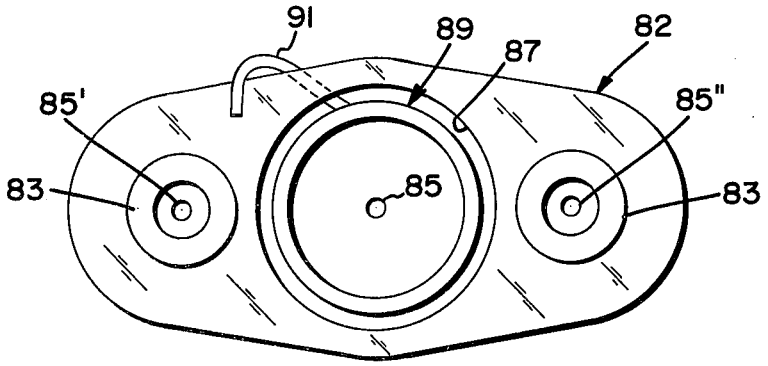
FIG. 7 is a plan view of the initial accelerator region of the gun structure shown in FIG. 6 taken along the line 7—7 therein.

Another structural embodiment 71 of the improved electron gun of the invention is shown in FIGS. 6 and 7 wherein the rear plural apertured portion 73 of the unitized focusing electrode 75 evidences a single protruding cup-like portion 77 wherein the aperture 79 for the center gun (G) is defined in a plane rearward and parallel to the plane wherein the apertures 79' and 79'' of the side related guns (B) and (R) are oriented. In this embodiment, the unitized side related initial accelerator members 81' and 81'' are substantially of planar construction being oriented in a substantially planar structure 82 having circular strengthening ribs 83 encompassing each aperture 85' and 85'' thereof. This planar structure has an annular opening 87 therein to accommodate the spatial placement thereinto of a substantially cup-shaped accelerator member 89 for the center gun (G). It has been found most expeditious to separately support the center gun cup-shaped accelerator member 89, as spacing difficulties were encountered when the cup-shaped accelerator was structurally incorporated into the aforementioned planar accelerator construction. Electrical connection is made between the cup-shaped member 89 and the planar accelerator member 82 by at least one strap-like means 91. The side related control electrode member 93' and 93'' are unitized in substantially the planar construction 95, such being similar to the construction of the initial accelerator members and oriented in an inverted manner spatially related thereto. Thus, the annular openings 87 and 87' in both the planar accelerator 82 and control electrode 95 unitized structures expeditiously accommodates the spaced positioning therein of the center gun initial accelerator member 89.

Thus, the improvement of the invention provides enhanced resolution of color cathode ray tube imagery with an associated increase in brightness. This improvement is achieved without increasing the neck diameter of the envelope. In keeping with the invention, one or more of the electron guns in a plural beam in-line electron gun assembly has modifications of the respective acceleration and focusing electrode members of the individual guns. Such structural modifications pertain primarily to the diameters of the respective output portions of the focusing electrode members and respective lengths thereof. The aperture diameters of the final acceleration electrodes are modified to be in keeping with the respective dimensionings of the associated focusing electrodes. The structurally affected dimensionings are directly relatable to the different levels of beam current assigned to the respective guns. Thus, final focusing lenses of substantially unequal diameters may be provided for the respective beams to effect beam landings of substantially balanced spot sizes at the screen.

While there has been shown and described what are at present considered the preferred embodiments of the invention, it will be obvious to those skilled in the art that various changes and modifications may be made therein without departing from the scope of the invention as defined by the appended claims.

What is claimed is:

1. An improvement in a cathode ray tube three-beam in-line bi-potential electron gun assembly having a longitudinal axis therethrough and including electron generating means formed to separately emit each of the respective electron beams of substantially differing current levels, such beams being directed from a center and two side-related guns to selectively impinge a spatially related patterned electron responsive screen, each of said beams emanating from a gun structure formed of a plurality of related electrode members including a control electrode, an initial accelerator, a focusing electrode and a final accelerator positioned and supported by longitudinal insulative members in a sequential manner forward of a rear-oriented cathode member to effect the formation and control of each of said beams, said improvement comprising:

a unitized final accelerator having three in-line apertures defined therein, the center one of which is larger in diameter;

a unitized focusing electrode structure having a forward apertured portion in the form of a planar integrating member wherein three in-line oriented apertures are defined in a common plane spatially related to the apertures of said final accelerator, the forward aperture of the center gun being larger than those of the two side-related guns, said forward apertures being located in a substantially common plane, said focusing structure having a rear aperture arrangement whereat three spatially related apertures are arranged to accommodate each of said beams, the rear apertures of all of said guns being substantially equal in diameter, said rear apertures of said side-related guns being located in a substantially common plane while the aperture of said center gun is in a separate rearward oriented plane parallel thereto;

an arrangement of apertured initial accelerator members positioned in substantially equal spaced relationship with the respective rear apertured portions of said focusing electrode structure, the aperture portions of the side-related accelerators being in a substantially common plane while the center gun accelerator is in a separate rearward oriented plane parallel thereto; and an arrangement of apertured control electrode members positioned in substantially equal spaced relationship with the respective initial accelerator members, the aperture portions of the side-related control electrodes being in a substantially common plane while the center gun control electrode is in a separate rearward oriented plane parallel thereto.

2. An improvement in a cathode ray tube three-beam in-line bi-potential electron gun assembly according to claim 1 wherein said forward apertured portion of the planar integrating member of said unitized focusing electrode structure has the respective apertures formed therein defined by peripherally in-turned projections whereupon three cylindrical members of said electrode structure are attached in a manner to extend rearward therefrom.

3. The improvement in a cathode ray tube three-beam in-line bi-potential electron gun assembly according to claim 1 wherein said side-related initial accelerator members are substantially planar and are oriented in a substantially planar structure having an annular opening therein to accommodate the placement thereinto of a substantially cup-shaped accelerator member for said center gun.

4. The improvement in a cathode ray tube three-beam in-line bi-potential electron gun assembly according to claim 1 wherein said control electrode members for the side-related electron guns are substantially planar being located in a common structure in a common plane, said control electrode structure having an annular opening therein to accommodate the spaced positioning therein of said center gun initial accelerator member.

5. The improvement in a cathode ray tube three-beam in-line bi-potential electron gun assembly according to claim 1 wherein said control electrodes and said initial accelerators of the respective guns are individual cup-shaped members, said control and accelerator members for the side-related guns being located in common respective planes, and wherein said control and accelerator members of said center gun are located in separate parallel planes to the rear of said similar members of said side-related gun structures.

* * * * *

UNITED STATES PATENT AND TRADEMARK OFFICE

CERTIFICATE OF CORRECTION

PATENT NO. : 4,029,988

DATED : June 14, 1977

INVENTOR(S) : Donald L. Say

It is certified that error appears in the above-identified patent and that said Letters Patent are hereby corrected as shown below:

Col. 5, line 15 - Delete "BD + Gd + Rd + a + b =D" and insert

-- Bd + Gd + Rd + a + b = D --

Signed and Sealed this

*Twenty-fifth* Day of *October 1977*

[SEAL]

*Attest:*

RUTH C. MASON
*Attesting Officer*

LUTRELLE F. PARKER
*Acting Commissioner of Patents and Trademarks*